US012404788B2

(12) United States Patent
Wu

(10) Patent No.: US 12,404,788 B2
(45) Date of Patent: Sep. 2, 2025

(54) OIL TANK CAP

(71) Applicant: COPLUS INC., Tainan (TW)

(72) Inventor: Po-Hua Wu, Tainan (TW)

(73) Assignee: COPLUS INC., Tainan (TW)

( * ) Notice: Subject to any disclaimer, the term of this patent is extended or adjusted under 35 U.S.C. 154(b) by 71 days.

(21) Appl. No.: 18/503,635

(22) Filed: Nov. 7, 2023

(65) Prior Publication Data

US 2024/0150091 A1 May 9, 2024

(30) Foreign Application Priority Data

Nov. 8, 2022 (TW) ..... 111212217

(51) Int. Cl.

| | |
|---|---|
| ***F01M 11/04*** | (2006.01) |
| ***B65D 41/02*** | (2006.01) |
| ***B65D 51/16*** | (2006.01) |
| ***B65D 53/02*** | (2006.01) |

(52) U.S. Cl.

CPC ..... *F01M 11/04* (2013.01); *B65D 41/02* (2013.01); *B65D 51/1644* (2013.01); *B65D 53/02* (2013.01); *B65D 2205/02* (2013.01); *B65D 2251/205* (2013.01); *F01M 2011/0491* (2013.01)

(58) Field of Classification Search

CPC ..... F01M 11/04; F01M 2011/0491; B65D 41/02; B65D 51/1644; B65D 53/02; B65D 2205/02; B65D 2251/205

See application file for complete search history.

(56) References Cited

U.S. PATENT DOCUMENTS

| | | | | |
|---|---|---|---|---|
| 3,831,801 A * | 8/1974 | Rodgers | F16K 17/19 137/493 |
| 3,937,357 A * | 2/1976 | Burgess | B65D 51/1644 220/203.26 |
| 2024/0151169 A1* | 5/2024 | Wu | B65D 41/02 |

* cited by examiner

*Primary Examiner* — James N Smalley

(74) *Attorney, Agent, or Firm* — Burris Law, PLLC

(57) ABSTRACT

An oil tank cap adapted to be removably engaged with an oil tank having an oil storing space. The oil tank cap includes a cap body, an air seal, and an air valve. The cap body includes an outer casing, and a cap base being plastic and one-piece, and defining an accommodation space with the outer casing. The cap base has an annular seat portion that has at least one exhaust hole, a tube portion, a separation portion having at least one ventilation hole. The air seal has a protrusion portion, and an annular body that encircles the ventilation holes. The air valve is inserted into the tube portion, is connected airtightly to the air seal, and is operable to open or close for balancing pressure of the oil storing space and pressure of an external environment.

8 Claims, 7 Drawing Sheets

OIL TANK CAP

CROSS-REFERENCE TO RELATED APPLICATION

This application claims priority to Taiwanese Utility Model Patent Application No. 111212217, filed on Nov. 8, 2022, the entire disclosure of which is incorporated by reference herein.

FIELD

The disclosure relates to an oil tank cap, and more particularly to an oil tank cap adapted to be removably engaged with an oil inlet of an oil tank.

BACKGROUND

A conventional oil tank cap is adapted to be removably engaged with an oil inlet of an oil tank, and includes a cap, a cap base that cooperatively defines an accommodating space with the cap, and other components. The manufacturing cost of the cap body of the conventional oil tank cap is significant due to the cap body being composed of a plurality of components that are riveted together by rivets. Furthermore, when the cap body is hit by a force, stress gathers around the riveted junctions, which may break the rivets or cause the components to be loose, thereby producing safety issues. Hence, there is room for improvement on the conventional oil tank cap.

SUMMARY

Therefore, an object of the disclosure is to provide an oil tank cap that can alleviate at least one of the drawbacks of the prior art.

According to the disclosure, the oil tank cap oil tank cap is adapted to be removably engaged with an oil tank. The oil tank has an oil storing space, and an oil inlet that spatially communicates with the oil storing space. The oil tank cap includes a cap body, a spring strip, an air seal, and an air valve. The cap body includes an outer casing and a cap base. The cap base is plastic and one-piece, and cooperates with the outer casing to define an air accommodation space. The cap base has an annular seat portion, a tube portion, and a separation portion. The annular seat portion is adapted to be disposed outside the oil inlet, and has an inner periphery, an outer periphery opposite to the inner periphery and connected to the outer casing, and at least one exhaust hole interconnecting the air accommodation space and an external environment. The tube portion extends from the inner periphery of the annular seat portion, and is adapted to extend into the oil inlet. The separation portion is connected to and disposed inside the tube portion. The air accommodation space is between the separation portion and the outer casing. The separation portion has an accommodating slot and at least one ventilation hole. The accommodating slot is formed in a middle of the separation portion, and is isolated from the air accommodation space. The at least one ventilation hole is disposed beside and spaced apart from the accommodating slot, and is adapted for interconnecting the air accommodation space and the oil storing space. The spring strip extends through the accommodating slot, and is adapted to be disposed in the oil storing space and adjacent to the oil inlet. The air seal is disposed in the tube portion of the cap body, abuts against the separation portion, and encircles the at least one ventilation hole. The air valve is inserted into the tube portion, is connected airtightly to the air seal, and is operable to open or close for balancing pressure of the oil storing space and pressure of the external environment.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
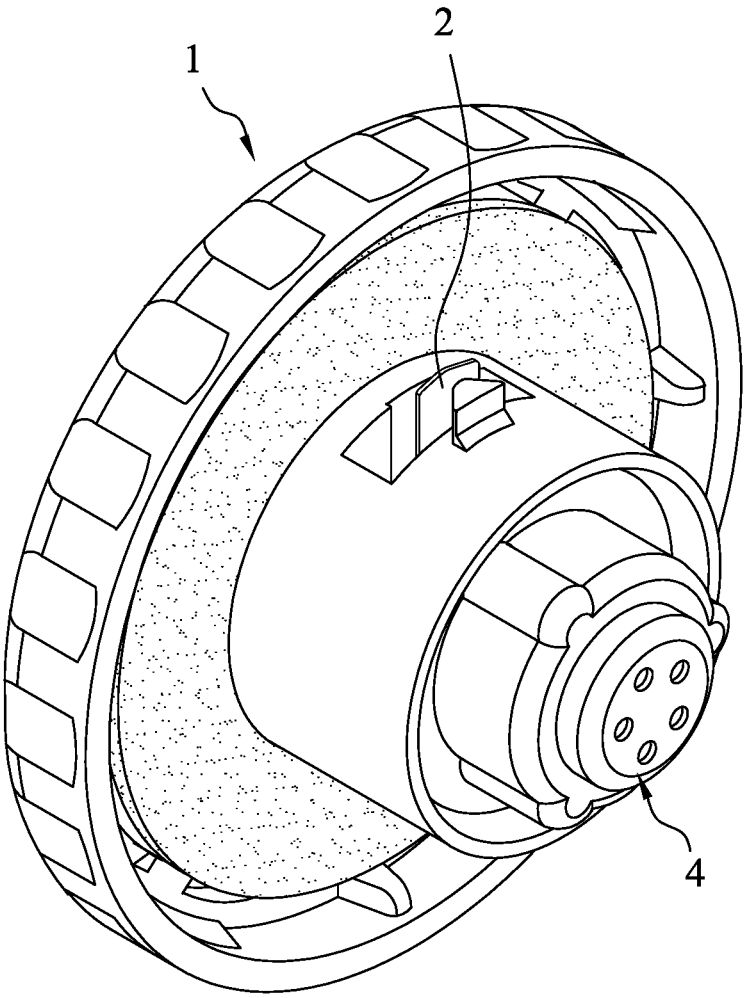
FIG. 1 is a perspective view illustrating an embodiment of an oil tank cap according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
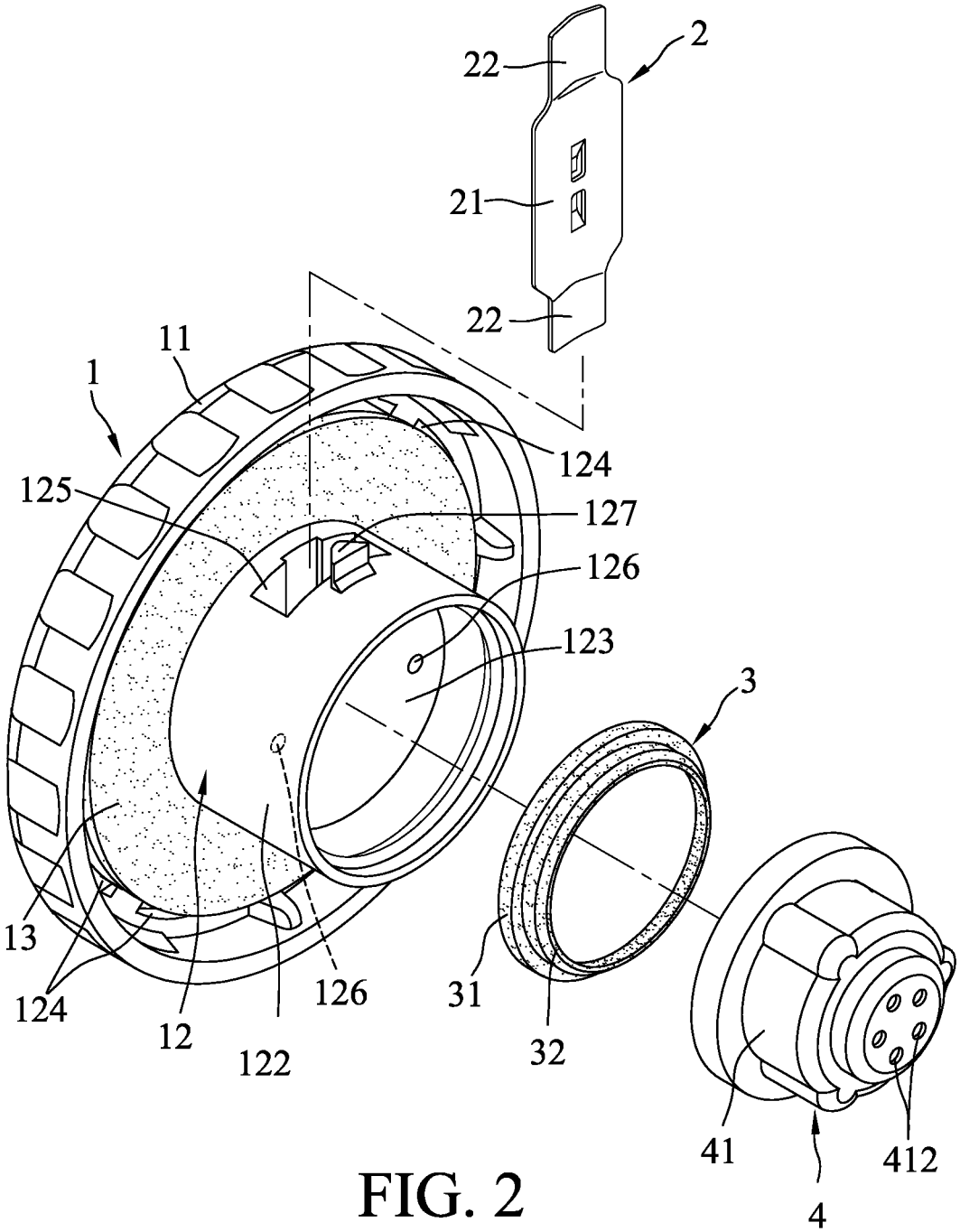
FIG. 2 is an exploded perspective view illustrating the embodiment.
Figure 4:
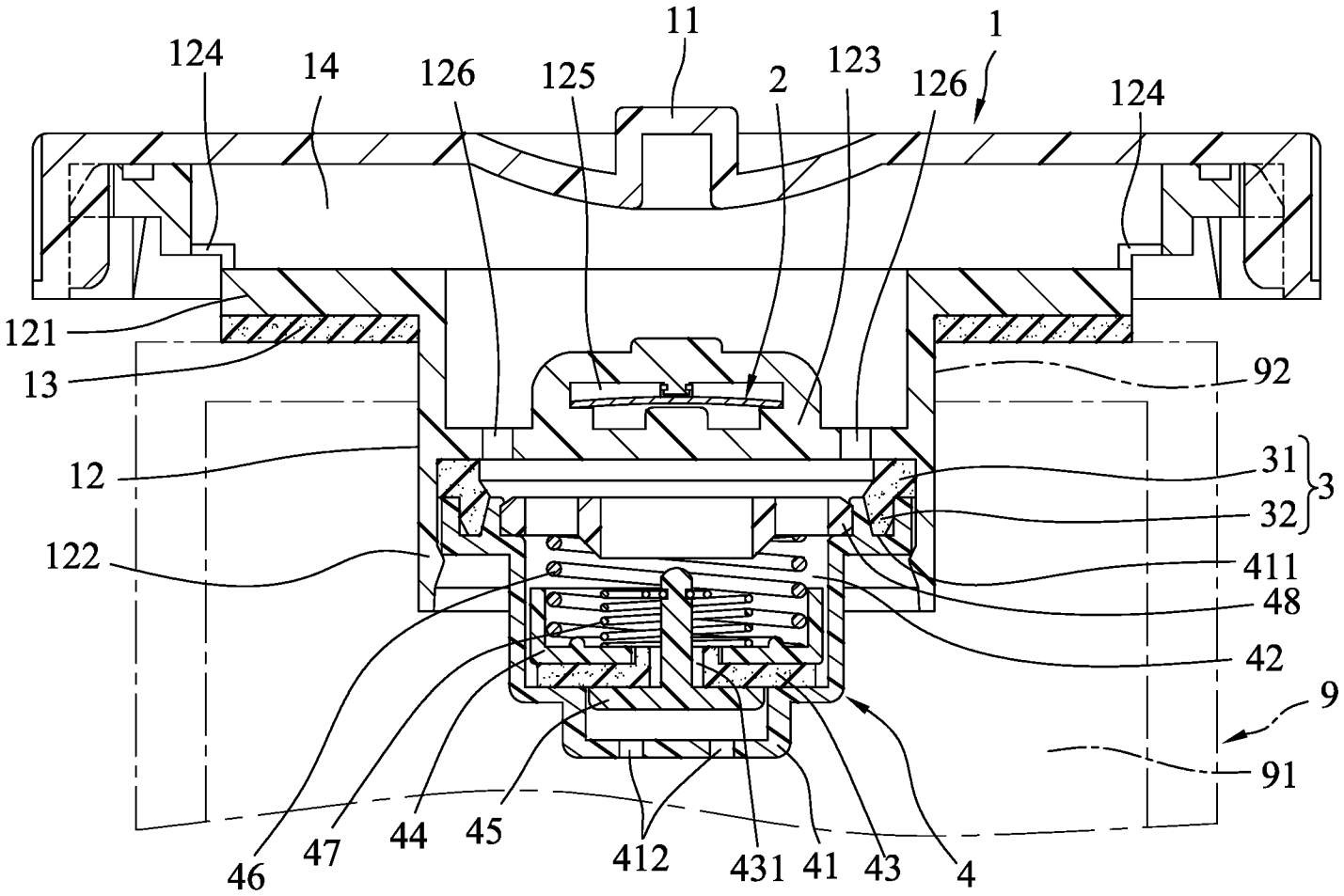
FIG. 4 is a sectional view of the embodiment, illustrating the air valve being closed.

Referring to FIGS. 1, 2, and 4, an embodiment of the oil tank cap is adapted to be removably engaged with an oil tank 9 of a vehicle, for example, an automobile (not shown). The oil tank 9 has an oil storing space 91 that is for storing fuel or lubricant, and an oil inlet 92 that spatially communicates with the oil storing space 91. The oil tank cap includes a cap body 1, a spring strip 2, an air seal 3, and an air valve 4.

Figure 5:
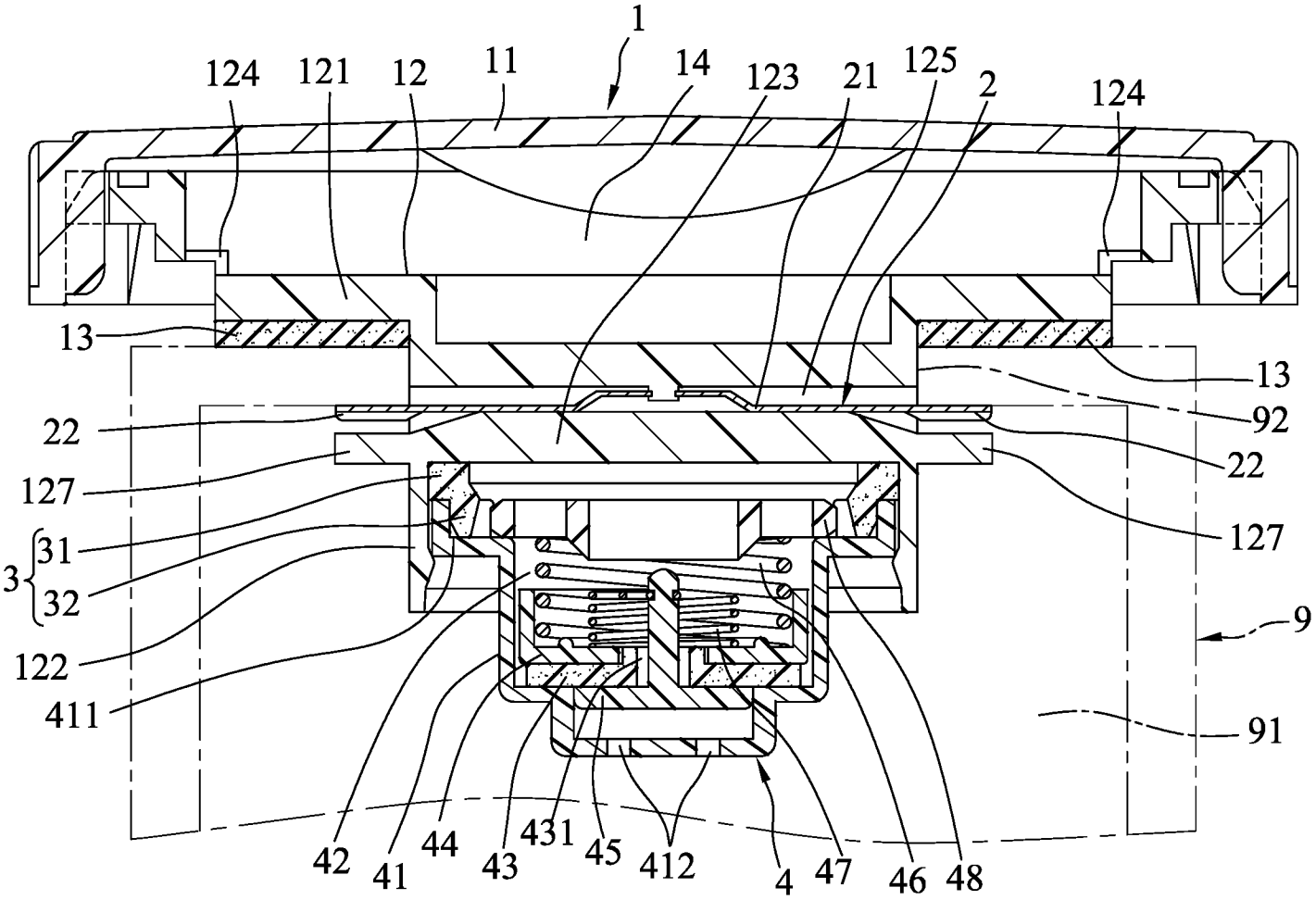
FIG. 5 is another sectional view of the embodiment, illustrating the air valve being closed.

Referring to FIGS. 2, 4, and 5, the cap body 1 includes an outer casing 11 for gripping, a cap base 12 cooperating with the outer casing 11 to define an air accommodation space 14, and a washer 13 sleeved on the cap base 12.

Specifically, the cap base 12 is made of a plastic material and is manufactured as one-piece. The manufacturing process may be implemented by, for example, molding. The cap base 12 has an annular seat portion 121, a tube portion 122, and a separation portion 123. The annular seat portion 121 is adapted to be disposed outside the oil inlet 92, and has an inner periphery and an outer periphery that is opposite to the inner periphery and that is connected to the outer casing 11. The tube portion 122 extends from the inner periphery of the annular seat portion 121, and is adapted to extend into the oil inlet 92. The separation portion 123 is connected to and disposed inside the tube portion 122. The air accommodation space 14 is between the separation portion 123 and the outer casing 11. In this embodiment, the annular seat portion 121 has eight exhaust holes 124 that are disposed around an inner periphery of the outer casing 11, that are equiangularly spaced apart, and that interconnect the air accommodation space 14 and an external environment. It should be noted that the number of the exhaust holes 124 is not limited to eight, and may vary as needed. The separation portion 123 has a flat surface at a bottom end thereof, and a protruding portion at a top end thereof with two recesses disposed on opposite sides of the protruding portion. The separation portion 123 further has an accommodating slot 125 that is formed in a middle thereof and that is isolated from the air accommodation space 14, and two ventilation holes 126 that are disposed beside and spaced apart from the accommodating slot 125 and that are adapted for interconnecting the air accommodation space 14 and the oil storing space 91. The washer 13 is sleeved on the tube portion 122, and is adapted to be cushioned between the annular seat portion 121 and the oil tank 9. The cap base 12 further has two limiting portions 127. Each of the limiting portions 127 extends from the tube portion 122, is disposed lower than a respective one of opposite ends of the accommodating slot 125, and has a triangular cross section. It should be noted that the number of the ventilation holes 126 are not limited to two, and the number may vary as needed.

The spring strip 2 is made of a metal material, extends through the accommodating space 125, and is adapted to be disposed in the oil storing space 91 and adjacent to the oil inlet 92. The spring strip 2 includes a positioning portion 21 disposed in the accommodating slot 125, and two abutting portions 22 extending respectively from opposite ends of the positioning portion 21 and extending outwardly of the accommodating slot 125. Each of limiting portions 127 of the cap base 12 is aligned with a respective one of the abutting portions 22 of the spring strip 2. Specifically, each of the abutting portions 22 is adapted to be disposed between the oil inlet 92 and a respective one of the limiting portions 127, and is adapted to abut against the inner surface of the oil tank 9 when the cap body 1 is rotated to be locked to the oil tank 9. Resilient deformation of the abutting portions 22 may be limited by the limiting portions 127. Specifically, when the cap body 1 or a surrounding area of the oil inlet 92 is hit by a force, the abutting portions 22 deform and abut respectively against the limiting portions 127, so that excessive deformation of the abutting portions 22 may be prevented. It should be noted that each of the abutting portions 22 of the spring strip 2 has an inverted V shape and complements each of the limiting portions 127. In other embodiments, the abutting portions 22 may be shaped differently.

The air seal 3 is ring-shaped and disposed in the tube portion 122 of the cap body 1, and includes an annular body 31 that abuts against the separation portion 123 and that encircles the ventilation holes 126, and a protruding portion 32 that extends from the annular body 31 and away from the separation portion 123 of the cap base 12.

The air valve 4 includes a valve base 41 inserted into the tube portion 122 and abutting tightly against the air seal 3. The valve base 41 and the separation portion 123 cooperatively define a control space 42 that is spatially connected to the ventilation holes 126. The valve base 41 has an annular groove 411 that is engaged airtightly with the protruding portion 32 of the air seal 3, and five air inlet holes 412 that are formed on a bottom of the valve base 41 and that are adapted for interconnecting the control space 42 and the oil storing space 91. It should be noted that the number of the air inlet holes 412 is not limited to five, and may vary as needed in other embodiments.

Figure 3:
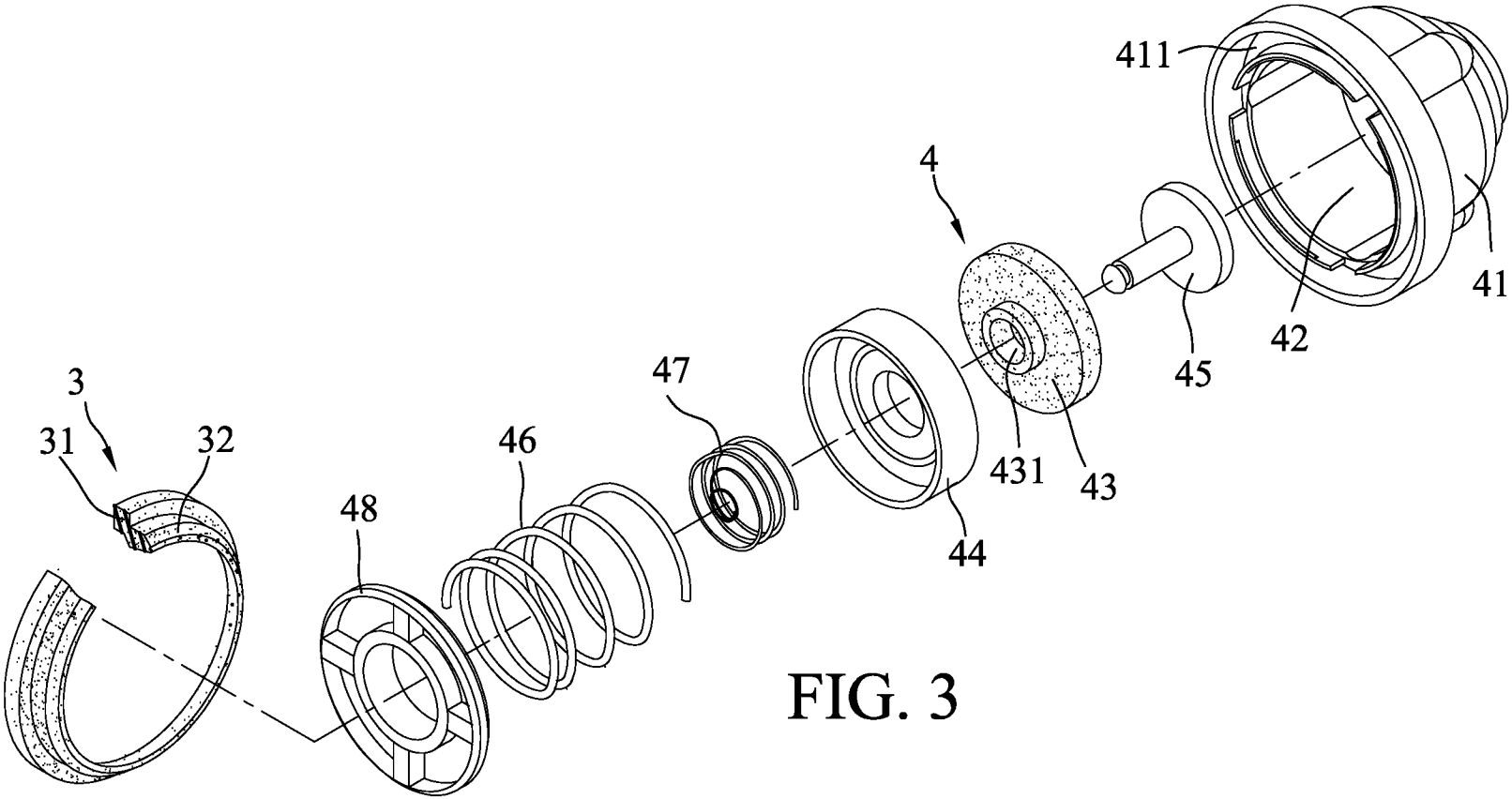
FIG. 3 is a fragmentary exploded perspective view of an air seal and an air valve of the embodiment.

Referring to FIGS. 3 to 5, the air valve 4 further includes a piston 43 movably disposed in the control space 42 and having a central hole 431, a spring seat 44 disposed on the piston 43 between the piston 43 and the separation portion 123, a pin rod 45 having a head portion and a pin portion, a large spring 46, a small spring 47, and a hollow plate 48. Specifically, the head portion of the pin rod 45 separably abuts against the piston 43 and is aligned with the air inlet holes 412, and the pin portion of the pin rod 45 extends co-movably from the head portion through the central hole 431 of the piston 43. The large spring 46 is mounted on the spring seat 44 for biasing the spring seat 44 towards the air inlet holes 412. The small spring 47 is connected between the spring seat 44 and the rod portion of the pin rod 45 for biasing the pin rod 45 away from the air inlet holes 412. The hollow plate 48 is disposed inside the valve base 41. The large spring 46 has opposite ends abutting respectively against the hollow plate 48 and the spring seat 44.

The air valve 4 is operable to open or close for balancing pressure of the oil storing space 91 and pressure of the external environment.

Figure 6:
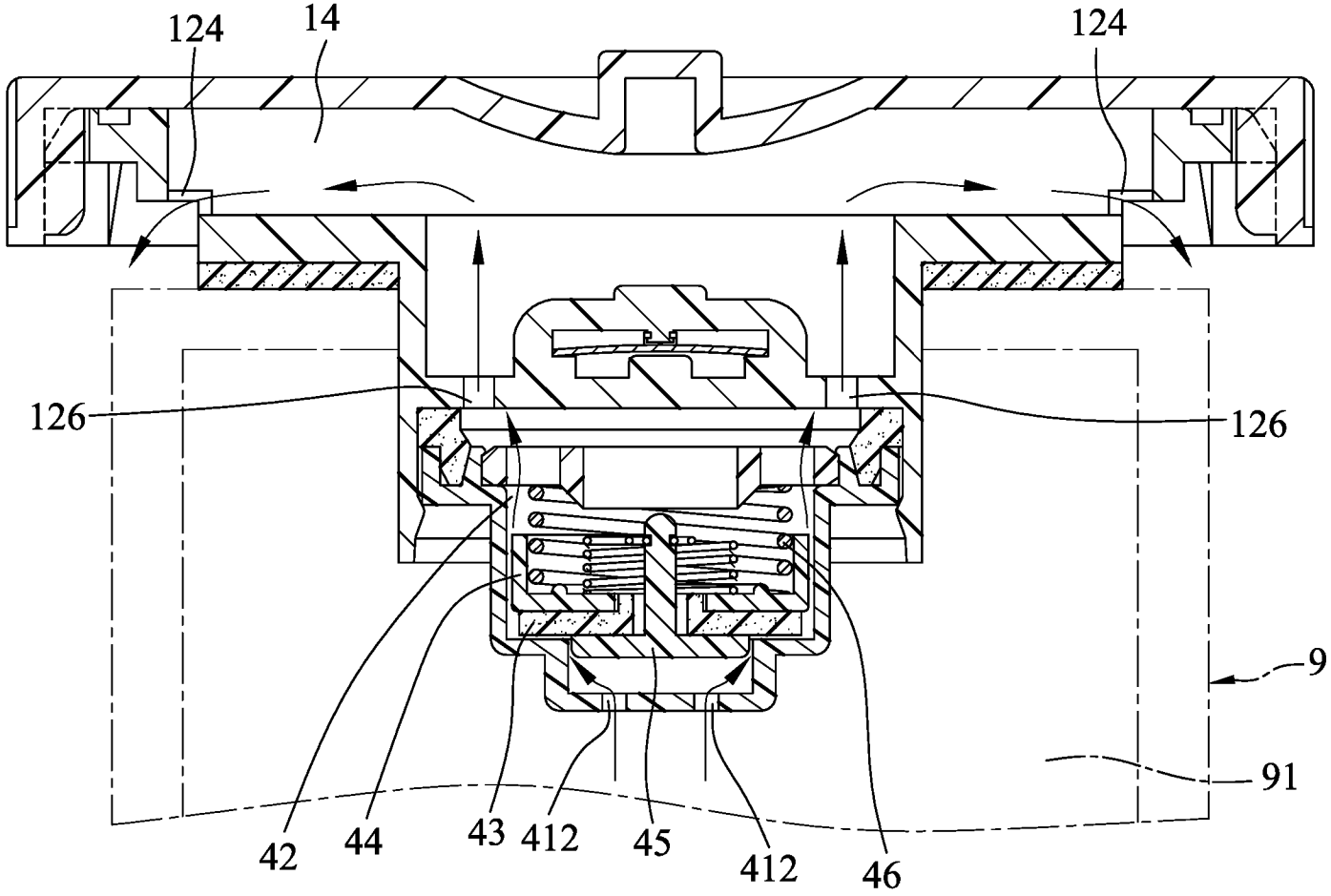
FIG. 6 is a sectional view similar to FIG. 4, but illustrating the air valve being opened to release air.

Referring to FIG. 6, the piston 43 is movable against a resilient force of the large spring 46 to permit or block passage of air, which enters the control space 42 via the inlet holes 412, from the control space 42 to the ventilation holes 126. For example, when a fuel or a lubricant volatilizes (i.e., passes off in vapor) inside the oil storing space 91, thereby causing the pressure of the oil storing space 91 to be higher than that of the external environment, the vapor enters the control space 42 through the ventilation holes 412, pushes against the head portion of the pin rod 45 and opens the air valve 4 by upwardly moving the pin rod 45, the piston 43, and the spring seat 44, thereby creating a gap among the pin rod 45, the piston 43 and the inner surface of the valve base 41, and allowing the vapor to enter the control space 42 via the gap, to advance into the air accommodation space 14 via the ventilation holes 126, and to finally flow into the external environment through the exhaust holes 124. When the pressure of the oil storing space 91 and the pressure of the external environment are balanced, the pin rod 45 is released, and the large spring 46 resiliently biases the spring seat 44 towards the air inlet holes 412 to close the air valve 4.

Figure 7:
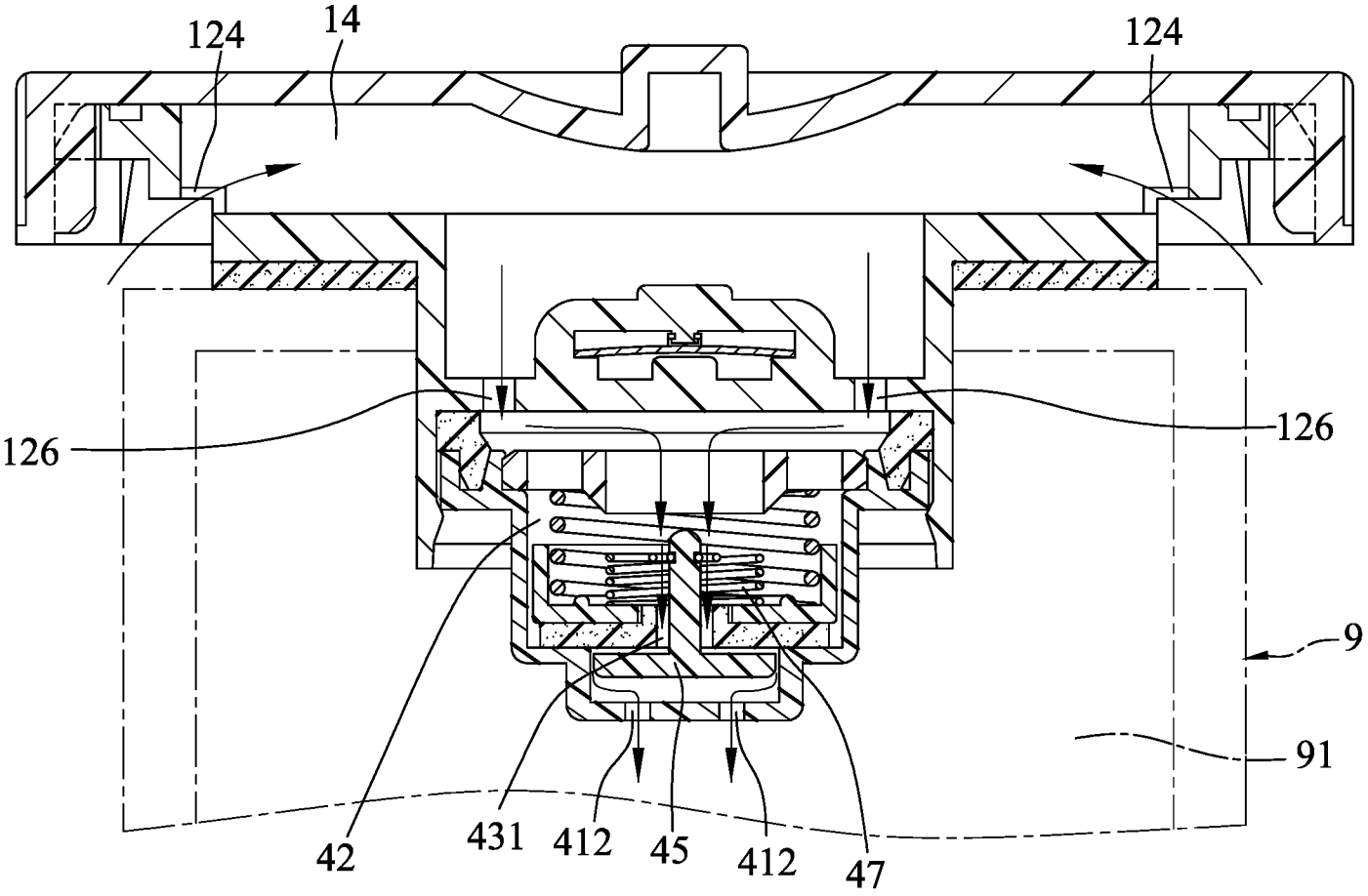
FIG. 7 is another sectional view similar to FIG. 4, but illustrating the air valve being opened to intake air.

Referring to FIG. 7, the pin rod 45 is movable against a resilient force of the small spring 47 to permit or block passage of air, which enters the control space 42 via the ventilation holes 126, from the control space 42 to the air inlet holes 412 via the central hole 431 of the piston 43. For example, when a large amount of the fuel or lubricant is extracted from the oil tank 9, thereby causing the pressure of the oil storing space 91 to be lower than that of the external environment, the pin rod 45 is downwardly drawn towards the air inlet holes 412, thereby creating a gap between the pin rod 45 and the piston 43, and allowing an airflow from the external environment to enter the control space 42 via the exhaust holes 124, to advance into the control space 42 via the ventilation holes 126, and to finally flow through the central hole 431, the gap, and the air inlet holes 412. After the pressure of the oil storing space 91 and the pressure of the external environment are balanced, the pin rod 45 is released, and the small spring 47 resiliently biases the pin rod 45 to close the air valve 4.

The advantages of the oil tank cap of the disclosure is as follows: By manufacturing the cap base 12 as one-piece, the structural strength and the safety of the oil tank cap increases, and the manufacturing cost is reduced. Hence, the objective of the disclosure is achieved.

Furthermore, by engaging the protruding portion 32 of the air seal 3 with the annular groove 411 of the valve base 41, the valve base 41 is sealed airtightly to the air seal 3, thereby preventing leaking of air or vapor between the valve base 41 and the tube portion 122. The protrusion portion 32 further has the function of positioning the air seal 3 and preventing deformation of the air seal 3, which may otherwise block the ventilation holes 126.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. An oil tank cap adapted to be removably engaged with an oil tank, the oil tank having an oil storing space, and an oil inlet that spatially communicates with the oil storing space, said oil tank cap comprising:

a cap body that includes an outer casing, and a cap base being plastic and one-piece, cooperating with said outer casing to define an air accommodation space, and having an annular seat portion that is adapted to be disposed outside the oil inlet, and that has an inner periphery, an outer periphery opposite to said inner periphery and connected to said outer casing, and at least one exhaust hole interconnecting said air accommodation space and an external environment, a tube portion that extends from said inner periphery of said annular seat portion, and that is adapted to extend into the oil inlet, and a separation portion that is connected to and disposed inside said tube portion, said air accommodation space being between said separation portion and said outer casing, said separation portion having an accommodating slot that is formed in a middle of said separation portion, and that is isolated from said air accommodation space, and at least one ventilation hole that is disposed beside and spaced apart from said accommodating slot, and that is adapted for interconnecting said air accommodation space and the oil storing space;

a spring strip that extends through said accommodating slot, and that is adapted to be disposed in the oil storing space and adjacent to the oil inlet;

an air seal that is disposed in said tube portion of said cap body, that abuts against said separation portion, and that encircles said at least one ventilation hole; and an air valve that is inserted into said tube portion, that is connected airtightly to said air seal, and that is operable to open or close for balancing pressure of the oil storing space and pressure of the external environment.

2. The oil tank cap that is claimed in claim 1, wherein:

said air seal includes an annular body abutting against said separation portion and encircling said at least one ventilation hole, and a protruding portion extending from said annular body and away from said separation portion of said cap base; and said air valve includes a valve base inserted into said tube portion of said cap base, abutting tightly against said air seal, and having an annular groove that is engaged airtightly with said protruding portion of said air seal.

3. The oil tank cap as claimed in claim 2, wherein:

said valve base and said separation portion cooperatively define a control space that is spatially connected to said at least one ventilation hole; and said valve base further has at least one air inlet hole that is adapted for interconnecting said control space and the oil storing space.

4. The oil tank cap as claimed in claim 3, wherein:

said air valve further includes a piston movably disposed in said control space, and having a central hole, a spring seat disposed on said piston between said piston and said separation portion, a pin rod having a head portion that separably abuts against said piston and that is aligned with said at least one air inlet hole, and a pin portion that extends co-movably from said head portion through said central hole of said piston, a large spring mounted on said spring seat for biasing said spring seat towards said at least one air inlet hole, and a small spring connected between said spring seat and said rod portion of said pin rod for biasing said pin rod away from said at least one air inlet hole;

said piston is movable against a resilient force of said large spring to permit or block passage of air, which enters said control space via said at least one air inlet hole, from said control space to said at least one ventilation hole; and said pin rod is movable against a resilient force of said small spring to permit or block passage of air, which enters said control space via said at least one ventilation hole, from said control space to said at least one air inlet hole via said central hole of said piston.

5. The oil tank cap as claimed in claim 1, wherein:

said spring strip includes a positioning portion disposed in said accommodating slot, and two abutting portions extending respectively from opposite ends of said positioning portion and extending outwardly of said accommodating slot.

6. The oil tank cap as claimed in claim 5, wherein:

said cap base further has two limiting portions, each of said limiting portions extending from said tube portion, being disposed lower than a respective one of opposite ends of said accommodating slot, and being aligned with a respective one of said abutting portions of said spring strip for limiting resilient deformation of said abutting portions.

7. The oil tank cap as claimed in claim 6, wherein:

each of said limiting portions of said cap base has a triangular cross section; and each of said abutting portions of said spring strip has an inverted V shape.

8. The oil tank cap as claimed in claim 1, wherein said cap body further includes a washer that is sleeved on said tube portion.

* * * * *